United States Patent [19]

Peters et al.

[11] 4,450,135

[45] May 22, 1984

[54] METHOD OF MAKING ELECTRICAL CONTACTS

[75] Inventors: Thomas E. Peters, Chelmsford; John C. Gustafson, Harvard, both of Mass.; Boon Wong, Reseda, Calif.

[73] Assignee: GTE Laboratories Incorporated, Waltham, Mass.

[21] Appl. No.: 336,648

[22] Filed: Jan. 4, 1982

[51] Int. Cl.[3] ..... B22F 1/00; B22F 3/00

[52] U.S. Cl. ..... 419/12; 419/27; 419/47; 419/31; 419/33; 75/244; 75/247; 75/254; 200/265; 252/513

[58] Field of Search ..... 419/12, 27, 38, 47, 419/33, 31; 252/513; 75/254, 244, 247; 200/265

[56] References Cited

U.S. PATENT DOCUMENTS 2,180,956 11/1939 Hensel ..... 419/12

2,234,969 3/1941 Hensel et al. ..... 200/266

OTHER PUBLICATIONS

Schlechten, A. W., "Zirconium", from *Rare Metals Handbook*, Hampel, ed., 1954, pp. 606–607.

Schwartzkopf and Kieffer, *Refractory Hard Metals*, p. 55, pp. 89–94, p. 282.

*Primary Examiner*—Brooks H. Hunt

*Attorney, Agent, or Firm*—Jerry F. Janssen; Ivan L. Ericson

[57] ABSTRACT

A method of preparing electrical contacts and electrical contact materials comprises the steps of blending a conductive metallic component, such as silver, with nickel and zirconium diboride which is substantially completely free of oxides, pressing the powder mixture to form a pre-sintered compact, and thereafter liquid phase sintering the compact to a densified body.

The zirconium diboride is mixed with about 2 weight percent of a reducing agent, preferably mixed carbon and boron powders, and heated to remove oxides from the surface of the zirconium diboride powder particles prior to the steps of pressing and sintering.

12 Claims, 3 Drawing Figures

METHOD OF MAKING ELECTRICAL CONTACTS

BACKGROUND OF THE INVENTION

This invention relates to methods of making electrical contacts and electrical contact materials which are typically used in medium voltage switching apparatus. More particularly, this invention concerns a method of making electrical contacts and contact materials containing zirconium diboride.

To be suitable for the above applications, a contact material should have high thermal conductivity, high electrical conductivity, high resistance to corrosion, high mechanical strength, low contact resistance, good electrical arc interruption capabilities, and minimal tendency for interfacial welding or sticking when employed in an electrical switching device.

It is known to make electrical contacts from a conductive material and a second material that tends to inhibit welding by weld embrittlement and to strengthen the composite. The conductive material, typically silver or copper, imparts high electrical and thermal conductivity to the contact while the refractory material contributes to the desirable properties of weld resistance, arc extinguishing, resistance to arc erosion, and increased mechanical strength of the composite.

Silver-tungsten composites are widely used as electrical contact materials in medium load circuit breakers. While these materials perform adequately with respect to arc erosion and weld inhibition, their oxidation resistance is relatively poor. During use, the interfacial resistance between opposed contact faces can progressively increase due to the formation of a semi-insulating surface layer of tungsten oxides and silver tungstates.

Composites employing silver or copper as the matrix component together with various carbides or borides as the refractory component have been evaluated as replacement electrical contact materials for silver-tungsten contacts because of their higher hardness, heats of vaporization, and resistance to oxidation. However, at elevated temperatures, most metal borides have a high chemical affinity for oxygen and as a result they have not found wide use as the refractory component of contact materials. In the cases of the borides of titanium, zirconium, and hafnium, for example, there is an initial, rapid reaction with oxygen to form a layer of oxide film on the surface of the boride particles. These films possess a high surface energy toward liquid silver. The presence of a passivating oxide layer on the surface of the boride particles precludes the preparation of composites with a strong silver-boride particle bond. The oxide layer easily forms and, once formed, is difficult to remove. Electrical contacts fabricated of silver and metallic borides in which a surface layer of oxide has formed on the boride during fabrication are generally porous, mechanically weak, and subject to more frequent failure under conditions encountered in an electrical switching application.

Thus, while silver-metal boride composites afford an attractive alternative to silver-tungsten composites as electrical contact materials, they are difficult to form into contacts having the requisite density and strength.

Various techniques have been employed in the fabrication of silver or copper based boride-containing electrical contacts and contact materials to inhibit the formation of an oxide layer on the borides, including vacuum sintering. These techniques, however, have met with varying degrees of success.

It is therefore an object of the present invention to provide an improved method of forming electrical contacts containing zirconium diboride.

It is another object of the present invention to provide powder mixtures suitable for compacting and sintering to produce electrical contacts containing zirconium diboride.

SUMMARY OF THE INVENTION

In accordance with one aspect of the present invention, a method for making electrical contacts comprises the steps of blending particulate zirconium diboride with from about 0.5 to about 2.0 weight percent of a particulate reducing agent, heating the mixture of zirconium diboride and reducing agent at a temperature and for a period of time sufficient to produce zirconium diboride substantially completely free of oxides, blending the oxide-free zirconium diboride with from about 20 to about 50 weight percent of a particulate conductive metallic constituent and from about 0.2 to about 1.0 weight percent of a particulate nickel constituent, compacting the blended mixture to produce a pre-sintered compact, and thereafter liquid phase sintering the compact to form a sintered body.

In another aspect of the present invention, a method of making a powder for compacting and sintering comprises the steps of blending particulate zirconium diboride with from about 0.5 to about 2.0 weight percent of a particulate reducing agent, heating the mixture of zirconium diboride and reducing agent to a temperature and for a period of time sufficient to produce zirconium diboride substantially free of oxides, comminuting the heated mixture to reduce aggregates formed during the heating step to particles of a size less than about 250 microns, and blending the comminuted oxide-free zirconium diboride with from about 20 to about 50 weight percent of a particulate conductive metallic constituent and from about 0.2 to about 1.0 weight percent of a particulate nickel constituent.

In yet another aspect of the present invention, a powder mixture suitable for compacting and sintering to form a densified composite body comprises from about 20 to about 50 weight percent of a particulate conductive metallic constituent, from about 0.2 to about 1.0 weight percent of a particulate nickel constituent, with the balance consiting essentially of particulate zirconium diboride substantially completely free of oxides.

Figure 1:
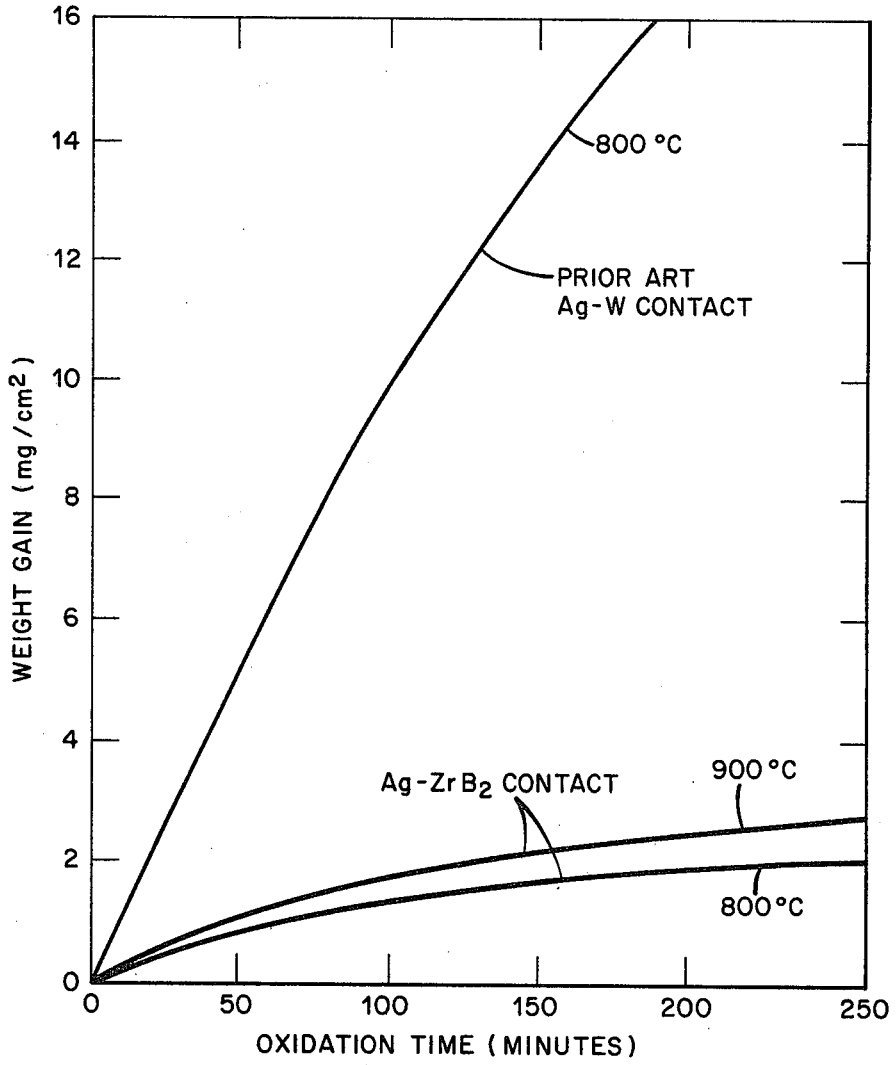
FIG. 1 is a graph illustrating comparative rates of oxidation of a prior art silver-tungsten electrical contact material and a silver-zirconium diboride electrical contact material made in accordance with the method of the present invention.

For a better understanding of the present invention, together with other and further objects, advantages and capabilities thereof, reference is made to the following disclosure and appended claims in connection with the above-described drawings.

DETAILED DESCRIPTION OF THE INVENTION

The electrical contacts and contact materials of this invention comprise a ductile metal or metal alloy which serves as the conductive metallic constituent for imparting the desirable properties of high electrical and thermal conductivity to the contacts. Silver is ideally suited for use as the conductive metallic constituent due to its chemical nonreactivity and commercial availability. Other metals such as copper, gold, platinum, or alloyed mixtures of these metals may be also used in place of silver.

A sufficient amount of a weld inhibiting material is included with the conductive metallic constituent to impart embrittling qualities to the final electrical contact. The weld embrittlement material is one which preferably does not alloy with the conductive metal constituent and which contributes to the breaking of welds which form during operation of an electrical switching device employing the contacts. In accordance with the present invention, the preferred weld embrittlement material is zirconium diboride which is substantially completely free of oxides.

Since the weld inhibiting or embrittlement material is generally a poor thermal and electrical conductor compared to the metallic phase, it is preferable that the conductive metallic constituent comprise a major portion of the volume of the electrical contact or contact material. In accordance with the method of the present invention, it is preferred that the conductive metal constituent of the contact materials comprise from about 20 to about 50 weight percent of the contact material, with small amounts in the range of from about 0.2 to about 1.0 weight percent of a metallic wetting agent, preferably nickel. The nickel wetting agent enhances the flow of the liquid phase into the interstices of the pressed compact during the sintering cycle. The balance of the electrical contact consists essentially of zirconium diboride which is substantially completely free of metallic oxides. For reasons set out above, the presence of oxides on the surface of the zirconium boride particles inhibits the wetting of the boride particles during the sintering cycle and leads to a sintered body which lacks the requisite strength for applications as electrical switching contacts.

The zirconium diboride is treated to remove any surface oxide which may form during the fabrication by the first step of the method of the present invention in which the starting zirconium diboride is mixed with powdered carbon and boron and heated. The zirconium diboride powder, preferably −325 mesh particle size, is mixed with finely divided carbon powder and boron powder. The carbon and boron preferably represent between about 0.5 and 2.0 weight percent of the mixture with the zirconium diboride and are present in roughly equimolar amounts.

The mixture of zironium diboride, carbon, and boron is next heated to a temperature at about 1800° C. under a flowing inert gas atmosphere, such as argon, for a period of about 1 to 2 hours to effect the reduction or vaporization of any oxide present. The reactions occurring between the materials present are believed to be:

$$C+4B=B_4C$$

$$2ZrO_2+B_4C+3C=2ZrB_2=4CO_{(g)}.$$

The above reactions were observed to take place at temperatures at and above about 1000° C. by both thermogravimetric analysis and mass spectrometry. Any $B_2O_3$ produced in this step of the process is vaporized at the heating temperature employed.

The resulting zirconium diboride is substantially completely free of oxides. The material is also substantially completely free of carbon as a result of both the chemical reactions alluded to above and the thermal conversion of any residual carbon to gaseous oxides during the heating step. There are generally small amounts of boron remaining in the mixture, but their presence does not adversely affect the final product since any boron remaining in the final sintered electrical contact is converted to the oxide and volatilized during arcing.

The oxide-free zirconium diboride is next comminuted to reduce the size of any aggregates formed during the heating step to form a powder having a −60 mesh particle size (less than about 250 microns). The comminuted oxide-free zirconium diboride is then mixed with finely divided nickel powder and finely divided silver powder. The total mixture preferably has a composition lying in the ranges of about 0.2 to about 1.0 weight percent nickel powder, about 20 to about 50 weight percent silver, with the balance consisting essentially of oxide-free zirconium diboride powder. The powder mixture is next compacted by cold pressing at pressures of about 20 tons per square inch.

The pressed compacts are next liquid phase sintered by heating under a flowing hydrogen or argon atmosphere at temperatures above about 1000° C., preferably about 1100° C. to about 1150° C., for a period of one-half to one hour. The sintered densities of the resulting bodies typically range between about 70 percent to 75 percent of theoretical.

In the final step of the method of this invention, the sintered bodies are infiltrated with additional silver by surrounding the sintered body with aluminum oxide and overlayering the body with additional powdered silver. The mixture is heated to a temperature above 1200° C. preferably about 1290° C. for about 30 minutes, again under flowing hydrogen or argon. The pores remaining in the sintered body are filled with additional silver, and the resulting sintered and infiltrated bodies have densities typically above about 98 percent of theoretical.

The following examples are given to enable those skilled in the art to more clearly understand and practice the present invention. The examples, however, should not be viewed as limiting the scope of the invention as defined by the appended claims, but as merely illustrative thereof.

EXAMPLE I

Powdered zirconium diboride powder (−325 mesh) was thoroughly mixed with about 0.79 weight percent of finely divided boron powder and about 1.02 weight percent finely divided carbon powder. The resulting mixture was held at 1800° C. for 90 minutes in a flowing argon atmosphere. The resulting powder mixture was ground in a mortar to −60 mesh particle size to remove large aggregates that had formed during the heat treatment.

The treated zirconium diboride powder was then thoroughly blended with 44 to 46 weight percent silver powder and 0.2 weight percent nickel powder. The mixture of boride and metal powders was cold pressed in one-half inch diameter die under a pressure of about 20 tons per square inch to produce pressed compacts. The resulting pressed compacts each weighed about four grams and had a density of approximately 70 percent of theoretical.

The green compacts were sintered at temperatures ranging between about 1100° C. and 1150° C. for 30 minutes in either a flowing hydrogen or flowing argon atmosphere. The sintered bodies which resulted had densities ranging between about 72 percent to 73 percent of theoretical.

The sintered bodies were encircled by an $Al_2O_3$ ring and were infiltrated from the top with silver at 1290° C. for 30 minutes in either a flowing hydrogen or flowing argon atmosphere. Excess silver metal remaining on the top of the infiltrated sintered bodies were ground off. The final sintered and infiltrated contacts had densities at least 98 percent of theoretical.

EXAMPLE II

Knoop microhardness tests were conducted on both a prior art silver-tungsten contact material and on silver-zirconium diboride contact materials made in accordance with the method of this invention. The microhardness tests were conducted on polished surfaces of the materials under 100 g load conditions.

The Knoop hardness values obtained were about 165 for the prior art silver-tungsten contact material, and about 220 for the silver-zirconium diboride contact material.

EXAMPLE III

To compare the oxidation resistance of prior art silver-tungsten contact materials with that of silver-zirconium diboride contacts made in accordance with the present method, coupons of each material were oxidized in flowing air at temperatures ranging between 800° C. and 900° C. The weight gain of each coupon was measured and recorded as a function of isothermal heating time. The results of the oxidation tests appear in FIG. 1 which shows the much improved oxidation resistance of the silver-zirconium diboride contact materials of the present invention over that of prior art silver-tungsten contact materials.

EXAMPLE IV

The electrical contact resistance, $R_c$, for a prior art silver-tungsten contact material and for silver-zirconium diboride contacts made in accordance with the present invention was measured in the cross-rod geometry at several loadings. The resistance was measured for each sample both on the as-processed material and on the material after oxidation in air ar 700° C. for three hours. All measurements were made at 1 A. with an open circuit voltage of less than about 10 V.

Figure 2:
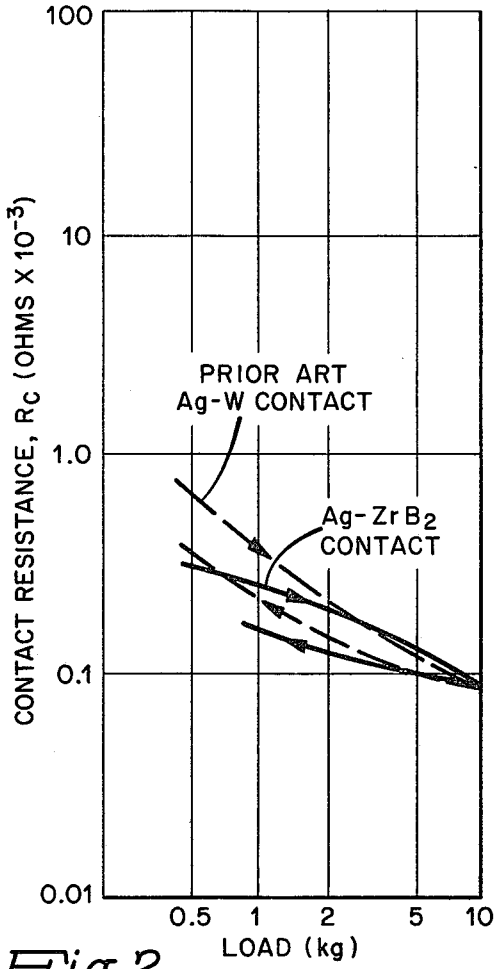
FIGS. 2 and 3 are graphs of the electrical resistance of a prior art silver-tungsten electrical contact material and a silver-zirconium diboride electrical contact material made in accordance with the present invention, measured at various interfacial loadings, before and after oxidation.

FIG. 2 illustrates the behavior of the as-processed contact samples prior to oxidation. The curves illustrate the similarity of behavior of the prior art silver-tungsten contact material and the present silver-zirconium diboride material.

Figure 3:
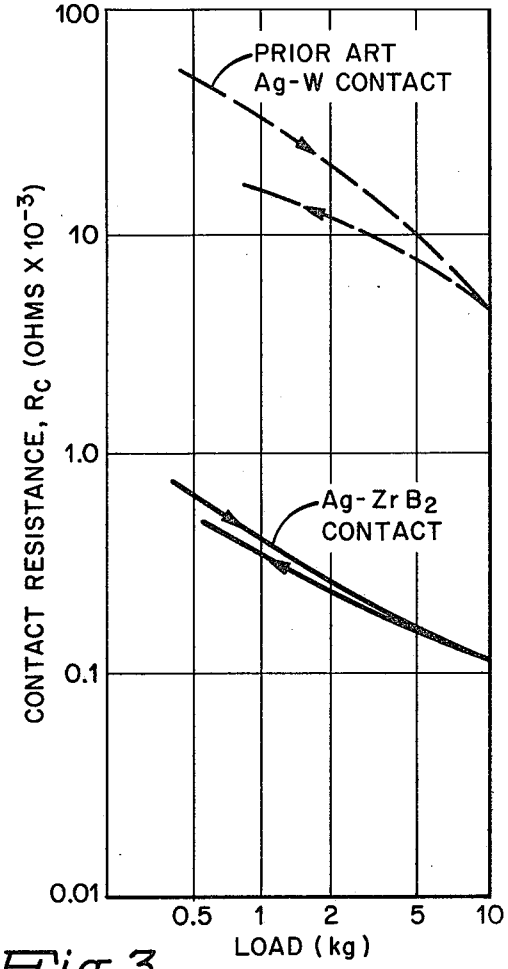

After oxidation, however, the behavior of the two materials as illustrated by the graph in FIG. 3 is markedly different. In the case of the silver-tungsten contact materials, oxidation results in the formation of tungsten oxide and silver tungstates on the contact surface. These materials are electrically insulating and are not volatilized under arcing conditions at the electrical contact points. The insulating layer formed by these materials accounts for the large increase in $R_c$ for the silver-tungsten material after oxidation treatment.

In the silver-zirconium diboride materials, the oxidation products are zirconium oxide and boric oxide. The boric oxide vaporizes during arcing at the electrical contact points while the $ZrO_2$ is non-volatile and is expected to remain on the contacts surface. The electrical conductivity is not appreciably altered by the $ZrO_2$ layer because it contains about the same volume fraction of conductive silver as the body of the contact.

EXAMPLE V

To simulate the volatilization of the boric oxide from the surface of the silver-zirconium diboride contact materials, samples of the contact material which had been oxidized in accordance with Example IV were soaked in water to dissolve away any boric oxide formed on the contact surface. After this treatment, there was a slight increase in $R_c$ for the silver-zirconium diboride contact which was attributed to a slight decrease in the volume of silver in the surface layer of the contact relative to the bulk composition.

The method of the present invention thus provides a means of preparing strong, non-porous electrical contacts of silver and zirconium diboride. The method affords a facile means of fabricating the contacts while preventing the formation of undesirable oxide coating on the diboride particles during the processing steps which would otherwise result in the production of contacts which lack the requisite strength and coherence for use as electrical contacts.

The resulting silver-zirconium diboride contacts have enhanced oxidation resistance over prior art silver-tungsten contacts, and demonstrate more consistent contact resistance during repetitive opening and closing of switching devices employing such contacts.

While there have been shown and described what are believed at present to be the preferred embodiments of the present invention, it will be obvious to one skilled in the art that various changes and modifications may be made therein without departing from the scope of the invention as defined by the appended claims.

What is claimed is:

1. A method for making electrical contacts consisting essentially of about 20 to about 50 weight percent conductive metallic constituent, from about 0.2 to about 1.0 weight percent metallic wetting agent with the balance consisting essentially of substantially completely oxide-free zirconium diboride comprising the steps of blending particulate zirconium diboride with from about 0.5 to about 2.0 weight percent of a particulate reducing agent consisting essentially of a mixture of carbon and boron, heating the mixture of zirconium diboride and reducing agent in an inert atmosphere at a temperature and for a period of time sufficient to produce zirconium diboride substantially completely free of oxides, blending the oxide-free zirconium diboride with from about 20 to about 50 weight percent of a particulate conductive metallic constituent and from about 0.2 to about 1.0 weight percent of a particulate metallic wetting agent, compacting the blended powder mixture, and liquid phase sintering the compacted powder in an oxygen free atmosphere to form a sintered body containing substantially completely oxide-free zirconium diboride.

2. A method in accordance with claim 1 wherein said carbon and said boron are present in substantially equimolar amounts.

3. A method in accordance with claim 1 further including the step of comminuting said oxide-free zirconium diboride to reduce the particle size of aggregates formed during said heating step to a size less than about 250 microns prior to said step of compacting.

4. A method in accordance with claim 1 wherein said particulate conductive metallic constituent consists of silver.

5. A method in accordance with claim 4 further including the step of infiltrating said sintered body with additional silver to form a body having a density at least 98% of theoretical.

6. A method in accordance with claim 5 wherein said particulate metallic wetting agent consists of nickel.

7. A method of preparing a powder for compacting and sintering comprising the steps of blending particulate zirconium diboride with from about 0.5 to about 2.0 weight percent of a particulate reducing agent consisting essentially of a mixture of carbon and boron, heating the mixture of zirconium diboride and reducing agent in an inert atmosphere at a temperature and for a period of time sufficient to produce zirconium diboride substantially completely free of oxides, comminuting the oxide-free zirconium diboride to reduce the particle size of aggregates formed during said heating step to a size below about 250 microns, and blending said comminuted oxide-free zirconium diboride with from about 20 to about 50 weight percent of a particulate conductive metallic constituent and from about 0.2 to about 1.0 weight percent of a particulate metallic wetting agent.

8. A method in accordance with claim 7 wherein said carbon and said boron are present in substantially equimolar amounts.

9. A method in accordance with claim 7 wherein said conductive metallic constituent consists of silver.

10. A method in accordance with claim 9 wherein said particulate metallic wetting agent consists of nickel.

11. A method for making electrical contacts consisting essentially of about 20 to about 50 weight percent conductive metallic constituent, from about 0.2 to about 1.0 weight percent metallic wetting agent with the balance consisting essentially of substantially completely oxide-free zirconium diboride comprising the steps of blending particulate zirconium diboride with from about 0.5 to about 2.0 weight percent of a particulate reducing agent consisting essentially of a mixture of carbon and boron wherein said carbon and said boron are present in substantially equimolar amounts, heating the mixture of zirconium diboride and reducing agent in an inert atmosphere at a temperature and for a period of time sufficient to produce zirconium diboride substantially completely free of oxides, blending the oxide-free zirconium diboride with from about 20 to about 50 weight percent of a particulate conductive metallic constituent consisting of silver and from about 0.2 to about 1.0 weight percent of a particulate metallic wetting agent consisting of nickel compacting the blended powder mixture, and liquid phase sintering the compacted powder in an oxygen free atmosphere to form a sintered body containing substantially completely oxide-free zirconium diboride.

12. A method of preparing a powder for compacting and sintering comprising the steps of blending particulate zirconium diboride with from about 0.5 to about 2.0 weight percent of a particulate reducing agent consisting essentially of a mixture of carbon and boron wherein said carbon and said boron are present in substantially equimolar amounts, heating the mixture of zirconium diboride and reducing agent in an inert atmosphere at a temperature and for a period of time sufficient to produce zirconium diboride substantially completely free of oxides, comminuting the oxide-free zirconium diboride to reduce the particle size of aggregates formed during said heating step to a size below about 250 microns, and blending said comminuted oxide-free zirconium diboride with from about 20 to about 50 weight percent of a particulate conductive metallic constituent consisting of silver and from about 0.2 to about 1.0 weight percent of a particulate metallic wetting agent consisting of nickel.

* * * * *